US007645064B2

(12) United States Patent
Cestti et al.

(10) Patent No.: US 7,645,064 B2
(45) Date of Patent: Jan. 12, 2010

(54) CONTINUOUS MIXING AND DELIVERY MACHINE FOR TEMPORARILY FLOWABLE SOLID MATERIALS

(75) Inventors: Alvaro A. Cestti, Alexandria, VA (US); Tommy Lee Foster, Alexandria, VA (US)

(73) Assignee: Onemanconcrete LLC, Alexandria, VA (US)

( * ) Notice: Subject to any disclaimer, the term of this patent is extended or adjusted under 35 U.S.C. 154(b) by 696 days.

(21) Appl. No.: 11/379,214

(22) Filed: Apr. 18, 2006

(65) Prior Publication Data

US 2006/0233040 A1 Oct. 19, 2006

Related U.S. Application Data

(60) Provisional application No. 60/672,030, filed on Apr. 18, 2005.

(51) Int. Cl.
*B28C 5/14* (2006.01)

(52) U.S. Cl. ..... 366/40; 366/41

(58) Field of Classification Search ..... 366/40, 366/41, 50, 318, 323
See application file for complete search history.

(56) References Cited

U.S. PATENT DOCUMENTS

| | | | | | |
|---|---|---|---|---|---|
| 264,861 | A * | 9/1882 | Caldwell | 366/40 |
| 1,753,716 | A | 4/1930 | Owen | |
| 1,959,465 | A * | 5/1934 | Dryfoos | 241/69 |
| 3,459,409 | A * | 8/1969 | Goldberger | 366/40 |
| 3,469,824 | A | 9/1969 | Futty et al. | |
| 3,986,708 | A * | 10/1976 | Heltzel et al. | 366/17 |
| 4,071,226 | A | 1/1978 | Miller | |
| 4,285,598 | A | 8/1981 | Horton | |
| 4,406,548 | A | 9/1983 | Haws | |
| 4,586,824 | A | 5/1986 | Haws | |
| 4,907,890 | A | 3/1990 | Lepper | |
| 4,922,463 | A | 5/1990 | Del Zotto et al. | |
| 4,953,752 | A | 9/1990 | Tousignant et al. | |
| 5,354,127 | A | 10/1994 | Del Zotto et al. | |
| 5,407,139 | A | 4/1995 | Mleczewski | |
| 5,470,147 | A | 11/1995 | Duckworth | |
| 5,529,247 | A | 6/1996 | Mleczewski | |
| 5,609,416 | A | 3/1997 | Duckworth | |
| 5,624,183 | A | 4/1997 | Schuff | |
| 5,730,523 | A | 3/1998 | Flood | |
| 5,967,655 | A | 10/1999 | Hills | |
| 6,123,445 | A | 9/2000 | Grassi | |
| 6,227,813 | B1 | 5/2001 | Leimer | |
| 6,422,731 | B2 * | 7/2002 | Weber | 366/8 |
| 2002/0001255 | A1 | 1/2002 | Flood et al. | |
| 2003/0002384 | A1 | 1/2003 | Flood et al. | |
| 2006/0280026 | A1 * | 12/2006 | Dackefjord | 366/8 |

* cited by examiner

*Primary Examiner*—David L Sorkin
(74) *Attorney, Agent, or Firm*—Bradford Kile; Scott Houtteman; Kile Goekjian Reed & McManus

(57) ABSTRACT

A mixing and delivery machine for flowable materials having on-site and towable mobility for mixing, hydrating, and delivering an admixture such as cementious mix, concrete, binder, graveled sand, mold sand and various other mixtures via an extended auger and elevatable hopper is used to facilitate both loading and releasing the hopper contents into the feed end of the auger. The auger is driven by a primemover and a wheel set on the machine facilitates the raising and lowering of the delivery end of the mixing auger.

7 Claims, 6 Drawing Sheets

CONTINUOUS MIXING AND DELIVERY MACHINE FOR TEMPORARILY FLOWABLE SOLID MATERIALS

BACKGROUND OF THE INVENTION

This application claims the benefit of Provisional Application No. 60/672,030 filed on Apr. 18, 2005. The disclosure of this provisional application is incorporated by reference as though set forth at length.

This invention relates to mixing and concomitant delivery of temporarily flowable solid materials at a use site. More specifically, this invention relates to mixing and delivery mixtures of concrete sand casting compositions, plates of paris compositions and the like.

There are a number of solutions to the problem of mixing and dispensing concrete; some of these demand use of heavy equipment while others use more specialized equipment and a number of personnel to operate the equipment. Other solutions involve lighter weight equipment or even portable equipment; yet much of the history of concrete making and placement on a small scale is characterized by the manual work of lifting, loading, mixing and manually hauling.

Complications revolve around mixing techniques including the need to control relative proportions of cement, sand and gravel and other additives. Substantial work has been completed in attempts to automate or mechanize proportioning of the ingredients. The need, of course, is to provide an end product that meets various building and construction code specifications. Moreover, there is general recognition within the community of those skilled in the art of handling that minimal handling or mixing of the hydrated concrete mixture is preferred prior to placement.

The use of dry premixed ingredients provides guaranteed proportions of the essential components without the end user having to be concerned about mixing proportions; further if the end user pre-mixes the dry components in a separate batch-type process rather than metering the ingredients in a continuous process the simplicity and reliability of the proportions is more readily achieved. Of course, it does not matter whether the end user actually performs the proportioning so long as the end user has assurance that a mix conforms to specified proportions.

As recommended by the Portland Concrete Association, the delivery and placement of a hydrated mixture should be performed with minimal handling and re-mixing once the initial hydrated mixture is created. Accordingly, both speed of placement and minimal handling are desirable features. Accordingly, facile handling with minimal personnel and minimal capital outlay for equipment is a desirable objective within the community of mixing and delivering concrete.

One prior arrangement comprises a wheeled concrete mixing device which incorporates a hopper mounted above a trailer frame. The trailer frame is linearly movable on track elements and delivers its contents to a conveyor belt located below the hopper. Here a two-hopper system is used and the second hopper feeds the flowable material to a screw conveyor. The second hopper in this system is rigidly mounted and fixed in relation to the trailer frame.

Another particulate mixer uses multiple hoppers fixed on a frame and the hopper support frame is also fixed in relation to a vehicle transport frame. In this system a set of feeding augers each driven by a separate hydraulic motor delivers contents to a final delivery auger. The final delivery auger is angularly fixed in relationship to the intermediate delivery augers during operation. Further the delivery auger is fixed in relationship to the ground because the final delivery auger exits to the side of the trailer frame.

Still another mixer uses a fully encased cover over a mixing and conveying auger and which uses the encasing cover as a structural frame support for the wheels, a towing hitch, a drive engine and a delivery hopper. An internal combustion engine driving the auger is located on the distal end of the auger assembly thus necessitating the placement of transport wheels near the distal end. This arrangement severely limits the adjustment of the delivery height of the distal or delivery end of mixing system and access to the auger chamber.

BRIEF SUMMARY OF THE INVENTION

The present invention presents a novel concrete mixing and delivery machine that employs a delivery hopper that can be pivotally elevated for supplying a flowable material to a powered auger that rotates within a confining chamber to provide a transporter for the flowable material. The moveable delivery hopper resides on a linkage system that permits the hopper to move into a lowered or loading position, which makes it convenient to load with flowable materials, and then permits the hopper to move into a raised or delivery position. In the delivery position, the hopper has a lower gate that facilitates movement of the flowable materials to a proximal end of the rotating auger.

The powered auger has a series of longitudinally spaced lift elements that urge the deposited mixture toward the distal end of the auger where the mixture exits the machine. This auger can be driven by a variable speed. Moreover, the auger can be serially segmented and different pitch of the blades can be selected in each segment to vary the rate of advancement.

A confining chamber for the auger is provided by a frame and side and bottom walls; this conveyor frame is attached to a main or base frame that houses the motive power for driving the auger and the linkage assembly that supports the hopper.

A set of wheels resides on the base frame and provides mobility on a work site; these transport wheels also create an angular adjustment capability for the delivery auger; a towing hitch resides at the distal end of the auger and provides road-type mobility.

Additionally, stabilizer arms operably extend from the base frame to provide overall stability of the machine as the delivery hopper is moved from the loading to the delivery position and vice versa.

THE DRAWINGS

Additional aspects of the present invention will become apparent from the following detailed description of the preferred embodiments thereof taken in conjunction with the accompanying drawing, which are for purposes of illustrating preferred embodiments of the present invention and not for purposes of limiting the scope of the invention:

FIGS. 9*a*-9*f* show a side elevation sequence of views of the machine in various stages of operation.

DETAILED DESCRIPTION OF THE INVENTION

Structure

Figure 1:
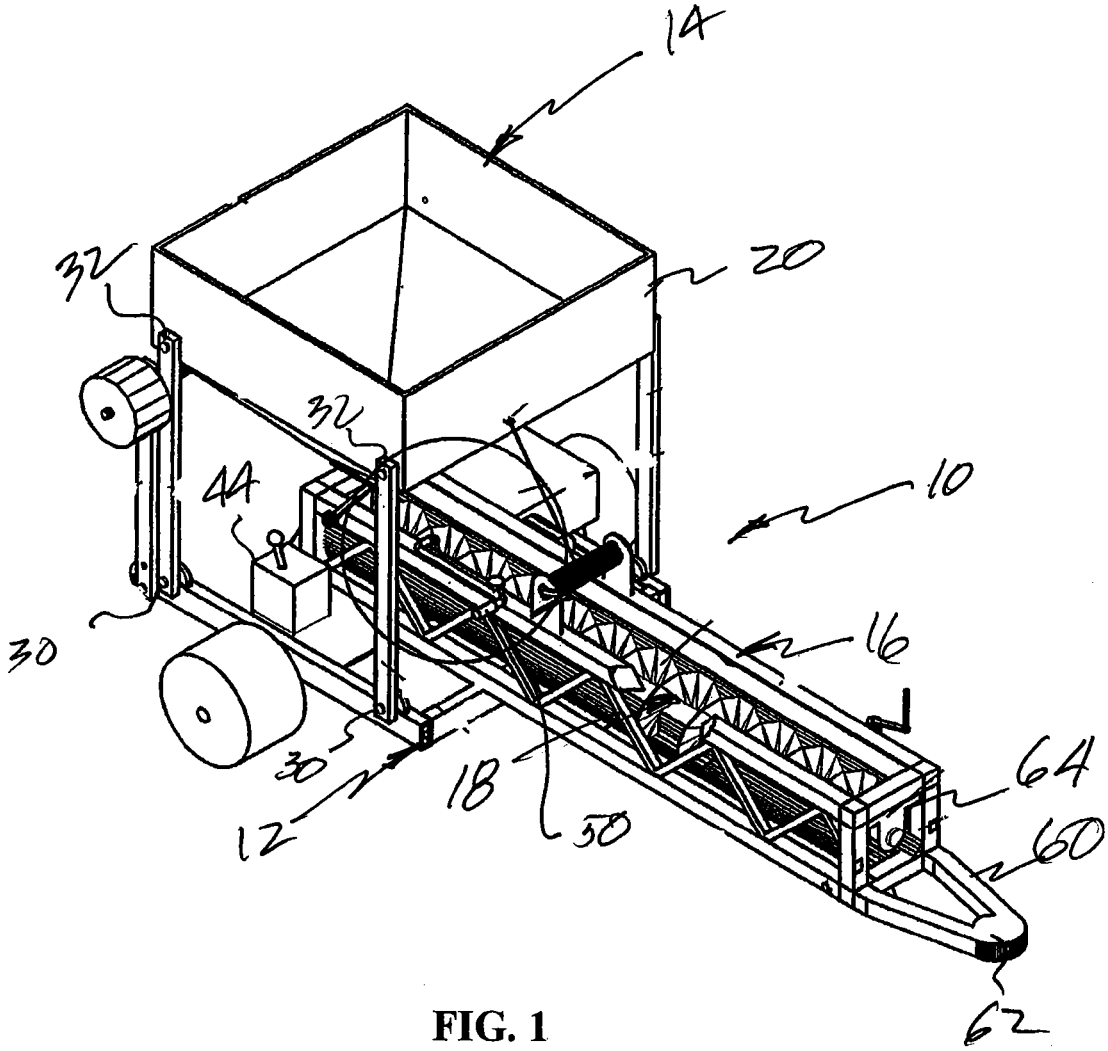
FIG. 1 is an axonometric view taken from a front perspective of the machine and showing a cutaway of the conveying section.
Figure 2:
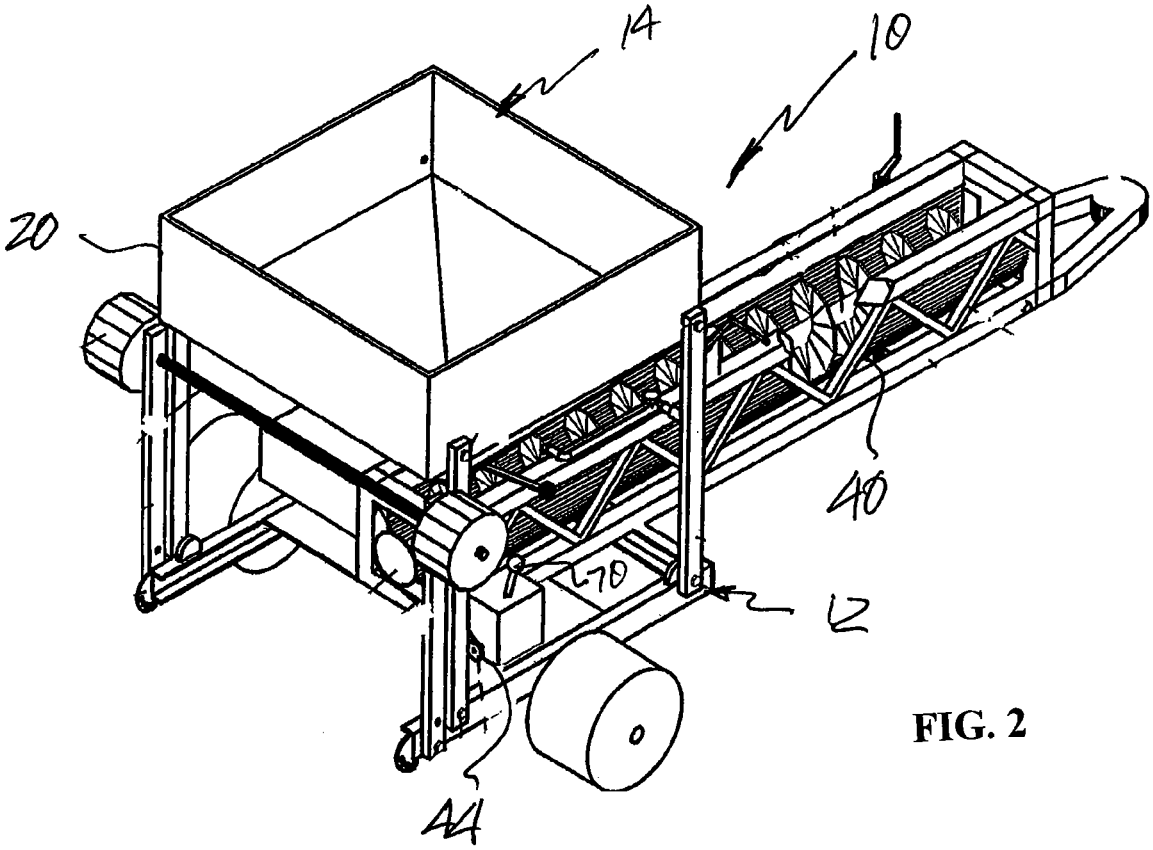
FIG. 2 is another axonometric of a rear perspective showing a conveyor auger.

Turning now to the drawings wherein like reference characters indicate the parts, FIGS. 1 and 2 disclose perspective views for mixing and conveying machine 10 in accordance with the invention. The mixing and conveying machine includes a base frame 2 a hopper 14 mounted on the base 12 and a mixing and conveyor frame 16 behind carries a mixing and conveyor system 18. The base 12 is mounted upon a set of wheels to facilitate transport as shown in FIG. 1.

The mobile hopper 14 has an openable port 20 on the lower end of the hopper to allow flowable material to be released. The hopper is preferably designed with square side walls 20 with generally inverted pyramid base 22, a slidable gate 24 to selectively deliver an admixture from the hopper into the mixing and conveying system 18

The hopper side walls 20 are supported at the corners by angle iron legs 28 that are pivotally mounted to the base 12 as at 30. The angle iron legs 28 are in turn pivotally connected to the side walls of the hopper 20 as at 32. At approximately a mid portion of the conveyor frame is a cable winch 34 which may be hand operated or power driven as desired to raise and lower the hopper 20 in an operative manner that will be discussed below in connection with FIG. 9.

Figure 5:
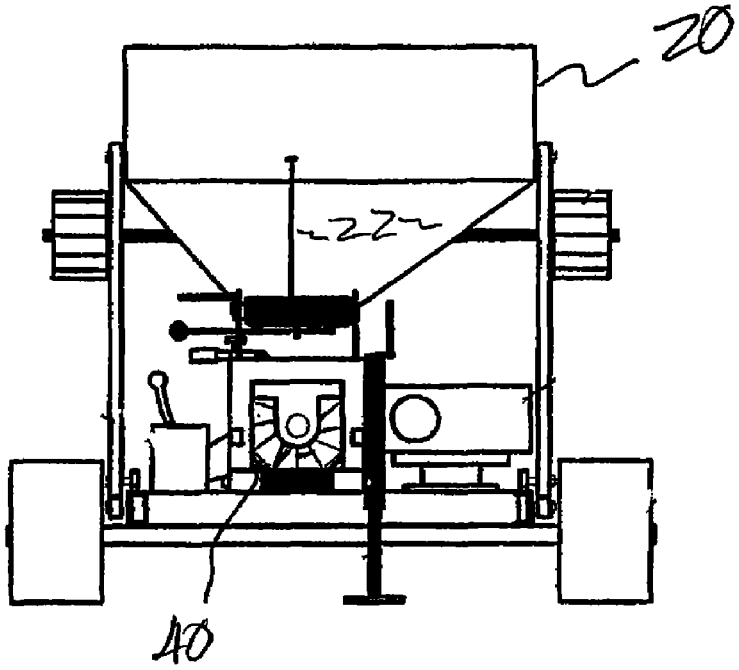
FIG. 5 is a front view of the concrete mixing and delivery machine shown in FIG. 1.
Figure 6:
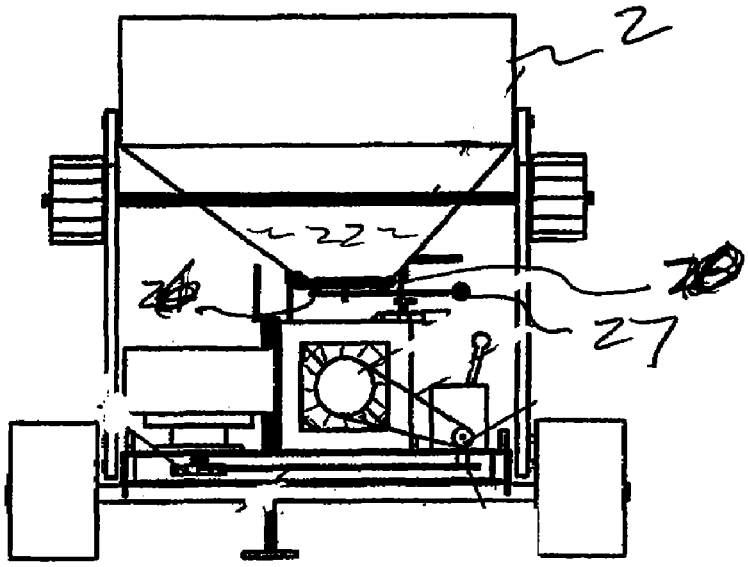
FIG. 6 is a rear view of the machine depicted in FIG. 1.

The conveyor frame 16 serves to support a mining and conveying system 18. This conveying system includes a base end wall 36 and side walls 38 which join into an arcuate base to form a trough, note FIGS. 2 and 5. A drive shaft 42 is journaled at each end within the trough and is operably connected to a prime mover 44 such as a hydraulic or electric variable speed motor. The motor is geared to the shaft at a base or proximal end of the conveyor beneath the hopper 14.

The drive shaft 42 operably carries a flight of auger blades 46 that serve to advance and mix material dropped into the trough from the hopper 14. The rate of advancement can be adjusted by varying the speed of the drive system motor 44 or transmission connected between the motor 44 and shaft 42.

In one embodiment the auger flights are mounted upon collars that are slid serially onto the drive shaft 42 and each segment is keyed to the shaft to rotate with the shaft. However, the pitch of each segment of auger blades may vary and thus the rates of advancement and mixing of the materials within the trough can be varied along the length of the trough.

Figure 8:
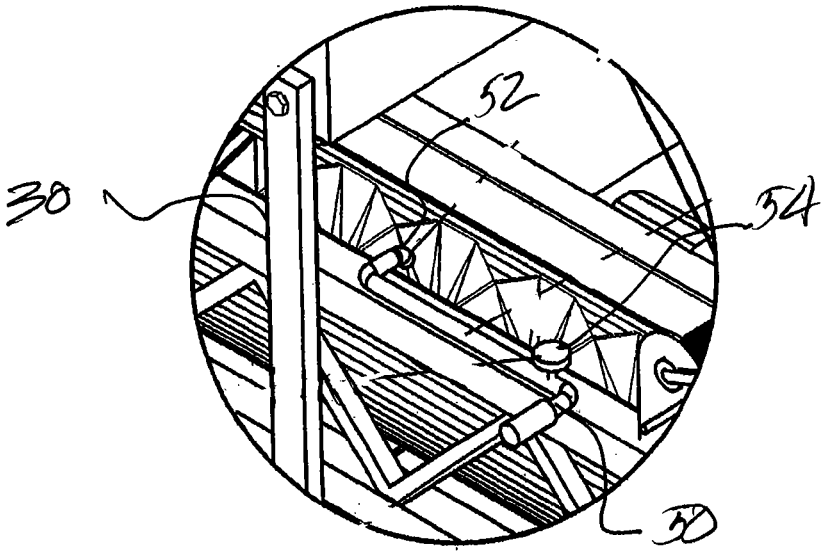
FIG. 8 is a detail view of a segment of FIG. 1.

Fluid can be added during the mixing and blending operation within the trough by a fluid line 50, note FIGS. 1 and 8 and a spray or drizzle nozzle head 52, a valve 54, which can be handled or remotely operated, serves to control the rate of fluid addition such as water to an admixture of concrete, solvent to a mixture of plastic particles, binder to sand for molding, and the like.

Figure 3:
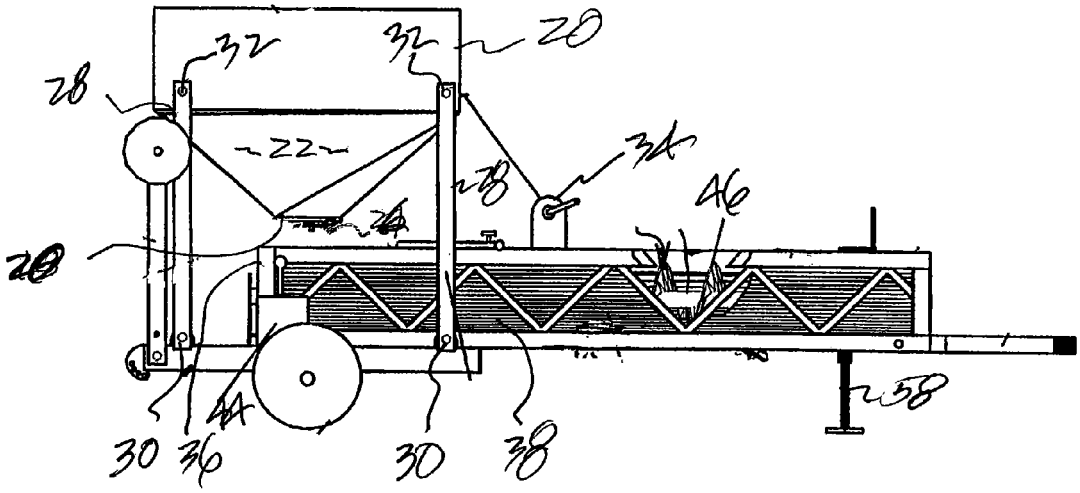
FIG. 3 is a side view of the machine depicted in FIG. 1.
Figure 4:
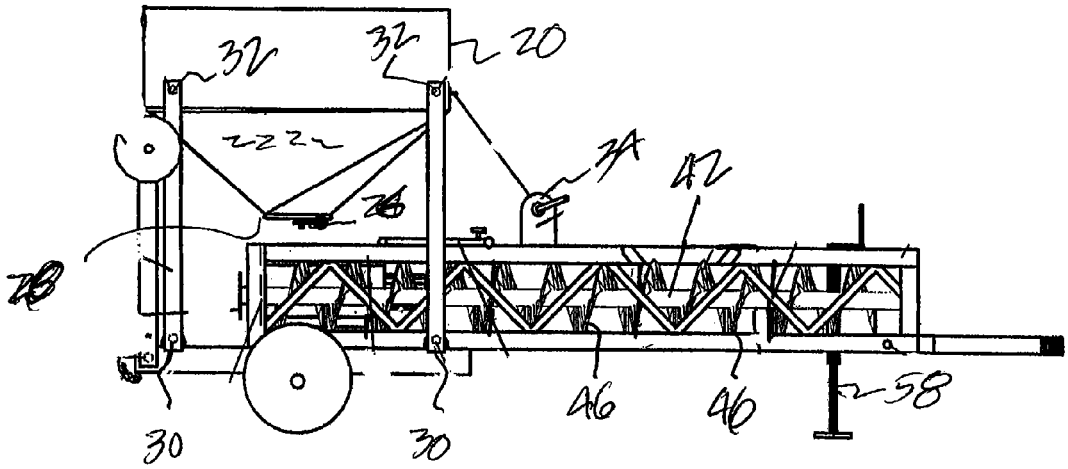
FIG. 4 is another side view of the machine with the side walls removed to disclose an interior auger delivery mechanism.
Figure 7:
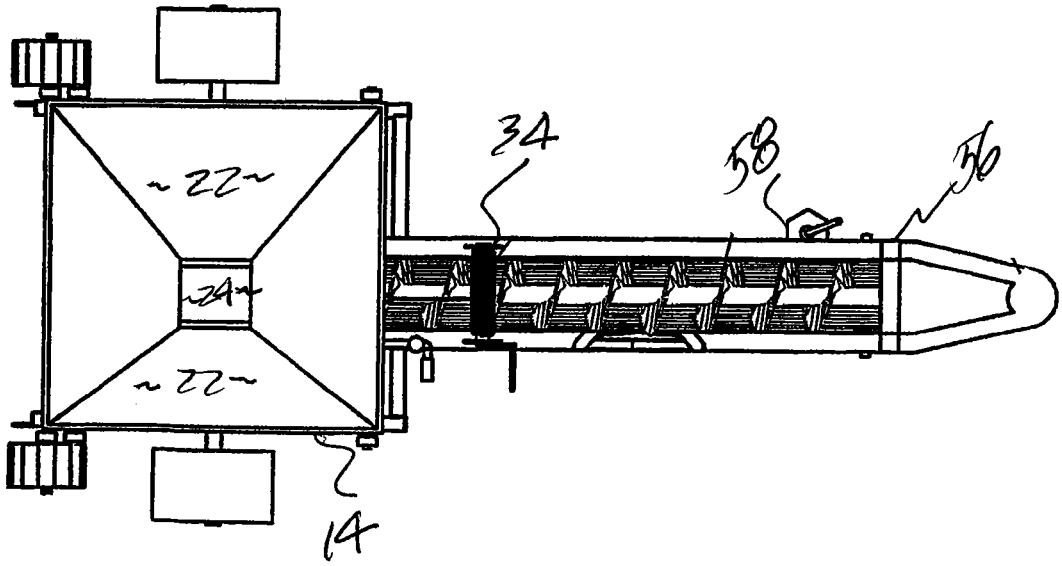
FIG. 7 is a plan view of the machine depicted in FIG. 1.

A distal end 56 of the mixing and conveying auger is supported by a hand adjustable stand 58, note FIGS. 3, 4 and 7 and an A-frame 60 terminates in a trailer hitch or eye opening 62 to facilitate transport of the unit on and to a job site. The distal end 64 of the mixing and conveyor system 18 is open and fluidized admixture are evicted from the trough by gravity through the A-frame 60 to a desired work location.

Operation

Figure 9A:
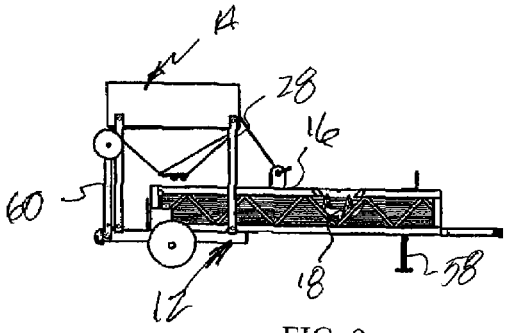
Figure 9B:
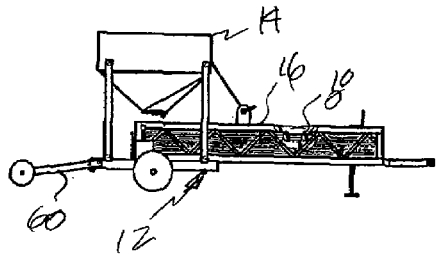
Figure 9C:
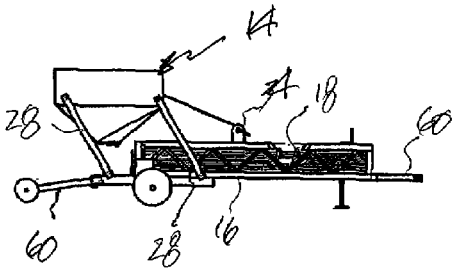
Figure 9D:
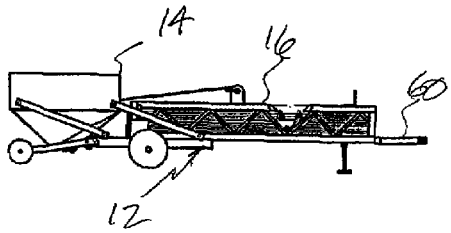

In operation the machine 10 is transportable to a worksite via conventional towing and is typically stationed as shown in FIG. 9*a*. Prior to beginning the loading operation for the movable delivery hopper 14 the stabilizer arms 60 are lowered and locked into ground engaging position as shown in FIG. 9*b*. The mobile hopper 14 is then lowered from a parked position to a loading position as shown in FIGS. 9*b* thru 9*d* via the cable winch system 34. Once the hopper has been loaded with dry ad mixture the winch system 34 is employed to return the hopper 14 into the parked or delivery position shown in FIG. 9*e*. Also as shown in FIGS. 9*e* and 9*f* the towing hitch 60 can be removed, as an option, to allow free delivery of a hydrated ad mixture from the distal end 64 of the mixing conveyor 18.

In the broadest sense the inventive machine is a general purpose mixing and delivery vehicle that mixes and conveys a delivery product to a useful port at the end of an auger. Such a machine finds ready utility in the manufacture of hydrated cement which undergoes initial hydration as the mix, which is initially dry, traverses the conveyor toward the distal delivery end of the system. By providing the various machine elements described in the foregoing paragraphs a ready mix cement product is produced in small and variable quantities as needed with the machine retaining the capability to supply large projects by either operating continuously or by continuing to supply batches or runs in quick succession so that a continuous pour or placement is accomplished. The instant inventive machine provides a solution to the problem of correct batch mix proportions by using a pre-mixed dry mixture that is received or loaded into the delivery hopper 14. Prior attempts to accurately and carefully meter out the proportions of sand, gravel and Portland cement at the exit point for hopper systems present complicated arrangements that are not required in this machine. Either an off-site mixed dry mix is used or a separate dry mixing machine (not a part of this invention) is used to provide a properly proportioned dry mix. Of course, the invention is not limited to use in mixing and delivering concrete as other admixtures of sand and binder, plastic pellets and solvent, plaster of paris and water, and other mixtures can be made with the subject invention.

Figure 9E:
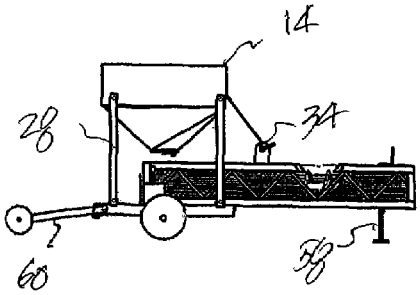
Figure 9F:
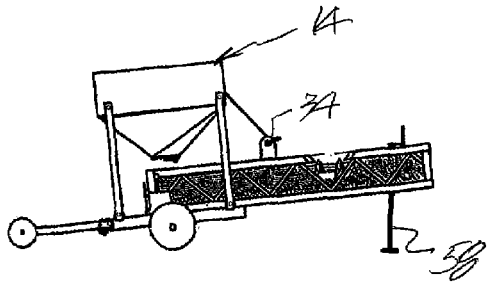

Once the dry mix is loaded into the delivery hopper the hopper is moved to the delivery position, FIG. 9*e*, and with the conveyor auger 46 rotating. The hopper delivery gate 24 is opened sufficiently to establish a continuous flow of dry mixture to fall by gravity onto the proximal end of the mixture and conveyor system. The hopper delivery gate 24 is manually operated by a lever arm 27 connected to a pivot and a linkage that connects to the slidable delivery gate 24. As the dry mix is further mixed by the lifts on the conveyor screw or helicoidal mixing element 46, a liquid supply system 50-52 provides the aqueous or other fluid component by way of a delivery hose joined to a quick connector on the delivery piping 50. A control valve 54 provides for graduated metering of the aqueous component that exits the liquid supply system at a delivery port 52 which is optionally fitted with a nozzle to disperse the aqueous component onto the traveling dry mix. As the mixing continues along the transporter trough the hydration step is accomplished and a ready fresh mix of cement for mortar or concrete exits the delivery port at the distal end 64 of the conveyor frame 16.

As has been inferred, the machine has a drive system to cause the auger 18 to rotate to deliver product. In this drive system the prime mover 44 which is optionally an internal combustion engine connected to a transmission and then to a prime sprocket gear on the proximal end of the auger shaft. The prime mover or drive engine produces the rotational forces to turn the auger. This rotational force producing prime mover is not limited to an internal combustion engine but could be an hydraulic or electric motor. The output shaft of the prime mover delivers high speed rotational forces via a drive pulley which typically accommodates a V-belt or a grooved belt to deliver force to the transmission input shaft. The flexible belt provides frictional engagement to the surfaces of the drive pulley and is trained around an input pulley that resides on the transmission input shaft. The transmission or gear box is a gear set or input-output variation device to reduce the high speed revolutions of the prime mover to make a suitable speed drive for rotating the auger. A gear shift lever 70 extends from the transmission to allow suitable speeds to be selected. An output sprocket resides on the transmission's output shaft and has an endless multi-link flexible chain trained around it and the prime sprocket gear to transfer the rotational forces from the transmission output shaft to the proximal end of the auger shaft 42.

The movement of the hopper is controlled by a cable winch system 34 which provides a mechanical connection between the auger frame 16 and the moveable delivery hopper 14 to urge the movement of the delivery hopper from a loading position shown in FIG. 9*d* to a delivery or parked position above the proximal end of the conveyor frame via a cable that is attached to the hopper by a hook eye. The dual parallelogram geometry of the hopper support arms 28 and arm stops control the center of gravity for the hopper to prevent travel over center allowing the cable winch system 34 to lower the hopper into the loading position by action of gravity.

In describing the invention, reference has been made to a preferred embodiment and illustrative advantages of the invention. Those skilled in the art, however, and familiar with the instant disclosure of the subject invention, will recognize additions, deletions, modifications, substitutions and other changes which fall within the purview of the subject invention.

What is claimed is:

1. A machine for mixing and conveying temporarily flowable solid materials to a delivery location comprising:

a base frame;

an elongated conveyor frame connected to said base frame;

a mixing conveyor mounted within said conveyor frame;

a material delivery hopper connected to said base frame;

an outlet located in a lower end of said delivery hopper for selectively admitting materials from the hopper into a proximal end of said conveyor; and fluid delivery system connected to said base frame for admitting a fluid into said conveyor wherein an admixture of materials are deposited into a proximal end of said mixing conveyor by said hopper and fluid is added to said conveyor and the admixture of materials and fluid are combined within the conveyor to deliver a mixture;

wherein said conveyor further comprises;

a set of side walls and a base residing on a conveyor frame so as to define a trough-like containment for the materials and fluid;

a delivery port resident at the distal end of said mixing conveyor; and a containment end wall located at the proximal end of said mixing conveyor;

a lifting system for said hopper, said lifting system including at least two legs pivotally connected between said base frame and said hopper; and means for pivoting said hopper from a lowered position with respect to said base to a parked end of said mixing conveyor.

2. A machine for mixing and conveying temporarily flowable solid materials to a delivery location as defined in claim 1 and further comprising:

at least a pair of movement wheels depending from of the base frame to facilitate movement of said machine to a desired deposit site.

3. A machine for mixing and conveying temporarily flowable solid materials to a delivery location as defined in claim 2 and further comprising:

a mixing conveyor drive system comprising a variable speed direct drive connection between said base frame and said mixing conveyor.

4. A machine for mixing and conveying temporarily flowable solid materials to a delivery location as defined in claim 3 and further comprising:

said mixing conveyor drive system includes a hydraulic motor.

5. A machine for mixing and conveying temporarily flowable solid materials to a delivery location as defined in claim 3 and further comprising:

said mixing conveyor drive system includes an electric motor.

6. A machine for mixing and conveying temporarily flowable solid materials to a delivery location as defined in claim 2 and further comprising:

a drive connection between a mixing conveyor drive system and said mixing conveyor comprising a transmission system.

7. A machine for mixing and conveying temporarily flowable solid materials to a delivery location as defined in claim 2 and further comprising:

a stabilizer arm extending from the base frame and having a projection in the direction of pivotal travel of the hopper as defined by the support arms for stabilizing the hopper in a lowered condition.

* * * * *